United States Patent [19]

Sato et al.

[11] Patent Number: 5,016,890

[45] Date of Patent: May 21, 1991

[54] SHOOTING GAME MACHINE

[75] Inventors: Yoshinori Sato, Kawasaki; Tatsuhisa Yabushita, Katsushika; Yoshihiro Mieda, Ohta; Hiroyuki Kobayashi, Katsushika; Yasufumi Tanabe, Yokohama; Satoshi Watanabe, Yokohama; Hideyo Oguri, Yokohama, all of Japan

[73] Assignee: Namco Ltd., Tokyo, Japan

[21] Appl. No.: 563,208

[22] Filed: Aug. 6, 1990

[30] Foreign Application Priority Data

Aug. 8, 1989 [JP] Japan ..... 1-205365
Aug. 8, 1989 [JP] Japan ..... 1-205366

[51] Int. Cl.[5] ..... F41J 5/02; F41J 9/02
[52] U.S. Cl. ..... 273/312; 273/370
[58] Field of Search ..... 273/312, 369, 370, 386

[56] References Cited

U.S. PATENT DOCUMENTS 2,188,292 1/1940 Hall et al. ..... 273/312
4,461,475 7/1984 Nakamura ..... 273/1 GC

FOREIGN PATENT DOCUMENTS 0276136 7/1988 European Pat. Off ..... 312/
579407 7/1976 Switzerland ..... 312/
2060407 United Kingdom ..... 312/

*Primary Examiner*—Benjamin Layno
*Attorney, Agent, or Firm*—Oliff & Berridge

[57] ABSTRACT

A shooting game machine features that movable members are hit so as to be prevented from reaching a goal, and comprises a plurality of lanes having a starting point and a turning point at both ends, a plurality of movable members moving from the starting point to the goal via the turning point. Each movable member has a hit indicator, adapted to be operated by the player, and movable member controller for returning the hit movable member to the starting point. The distance between the starting point and the turning point is gradually shortened each time the movable member reaches the turning point so as to make the shooting game more difficult.

19 Claims, 8 Drawing Sheets

SHOOTING GAME MACHINE

1. FIELD OF THE INVENTION

This invention relates to an improvement of a shooting game machine in which movable members are disposed on lanes, and are movable thereon, and are adapted to be hit by a player so as to prevent them from reaching a goal.

2. DESCRIPTION OF THE RELATED ART

Heretofore shooting game machines have been known, in which movable members are hit by a gun adapted to be operated by a player. A variety of machines have been available.

One of such machines comprises a plurality of lanes having a starting point and a turning point at ends thereof, movable members which are able to start from the starting point and are able to turn at the respective turning point to march toward a goal. In such a machine, a game is over when at least one of the movable members reaches the goal.

During the game, when it is shot by the gun operated by the player, the movable member returns to the starting point and restarts therefrom. Then the player further tries to hit the restarting movable member, and can enjoy the game by preventing the movable member from reaching goal during the predetermined certain period of time.

In a conventional shooting game machine, the starting point and the turning point of individual lanes are always fixed, and the distance therebetween remains the same.

This implies that difficulty of the shooting game itself does not change at all from the beginning to the end, and accordingly the player will become less tense and be less interested in the game as it goes on.

With such a shooting game, it is a must to keep the player interested in the game, tense and excited even if he plays the game repeatedly.

Generally, the shooting game machine is adapted to be such that the player enjoys the game by operating a gun to shoot targets.

In addition, the conventional shooting machine is designed only to cause the hit movable members fall down backwardly, and cannot enable the player visually to produce the situation in which the individual movable member is shot.

There have been a number of shooting game machines in which the gun emits light beams, or infrared rays. Therefore, it has been required to perform the hit action resembling the real hit action so neatly that the player can visually produce the situation in which the movable members are shot by his gun.

SUMMARY OF THE INVENTION

Therefore it is an object of this invention to provide a shooting game machine, which can increase difficulty of the game according to the progress of the game so that the player can enjoy the game with tension, excitement, and satisfaction.

It is another object of this invention to provide a shooting game machine which is adapted to enable the player to visually produce the situation in which the individual movable member is shot.

To accomplish the first object of the invention, there is provided a shooting game machine comprising: a plurality of lanes having a starting point and a turning point at ends thereof respectively; a plurality of movable members which are able to start from the starting point and able to turn at the respective turning point to march toward a goal; hitting means adapted to be operated by a player for hitting the movable members in an effort to prevent the movable members from reaching the goal; movable member control means for returning the hit movable members to the starting point and restarting them therefrom; and means for moving the turning point toward the starting point so as to shorten the distance between the starting point and the goal and to make the game more difficult each time the movable members reach the turning point.

To achieve the second object of the invention, the shooting game machine is characterized in that each of the movable members comprises a character portion bearing a character, a target portion at which the player may take aim, and a hit detector disposed in the target portion so as to detect the hitting of the movable member. Each of movable member is adapted to fall down by the reaction of the hitting and to move toward the starting point so that the player can visually produce the situation in which the individual movable member is shot.

In operation, when a game is started, individual movable members begin to move from the starting points to the turning points on individual lanes.

Then the movable members reach the turning points, and shift their courses toward goals. The starting points and the goals may be provided separately, or the starting points may also serve as the goals.

A player operates hitting means and hits the movable members one after another in an effort to prevent them from reaching the goals The hitting means may be a gun adapted to be operated by the player Each time the movable members are hit, they return to the starting points and restart therefrom.

The game machine of this invention is characterized in that when a movable member is hit after it reaches the turning point, the turning point is shifted toward the starting point so as to shorten the distance between the starting point and the goal via the turning point.

Since the distance between the starting point and the goal is long enough at the beginning of the game, even a player unfamiliar to the game can hit the movable members with ease and can enjoy the game.

When a number of the movable members reach the turning points, the distances between the starting points and the turning points are gradually shortened, making the shooting game more difficult. In other words, the player is required to hit movable members on respective lanes while paying attention to the positions of respective turning points.

Since the game becomes gradually harder as it goes on, the player can enjoy it while feeling tense.

At the latter stage of the game, since the distances between the starting points and the turning points are shortened on a number of lanes, the player must be always attentive, which will keep him much excited and satisfied during and after the game.

When this invention is applied to a shooting game machine, the hitting of the movable member is detected by a hit detector. If it is hit, the movable member is caused to fall down by the reaction of the hitting and move toward the starting point.

Such a series of the hitting of the movable members resembles the real hit action so that the player can visually enjoy the situation in which the individual movable member is shot and knocked off by his gun.

To sum up, while playing the shooting game, the player can not only enjoy the hitting of the moving targets but also visually produce the situation in which the individual targets are shot and knocked off. In other words, the player can enjoy the shooting game as if he actually operates a real gun, and will be more excited and satisfied than when he plays the shooting game with a conventional shooting game machine.

The above and other advantages, features and additional objects of this invention will be manifest to those versed in the art upon making reference to the following detailed description and the accompanying drawings in which a preferred structural embodiment incorporating the principles of this invention is shown by way of illustrative example.

DETAILED DESCRIPTION

The principles of this invention are particularly useful when embodied in a shooting game machine, such as shown in the accompanying drawings. Here in this specification, the term "shooting" means hitting a target by a bullet, emitted from a light-beam gun or a BB (air) gun, or hitting a target by a hammer or the like.

Figure 2:
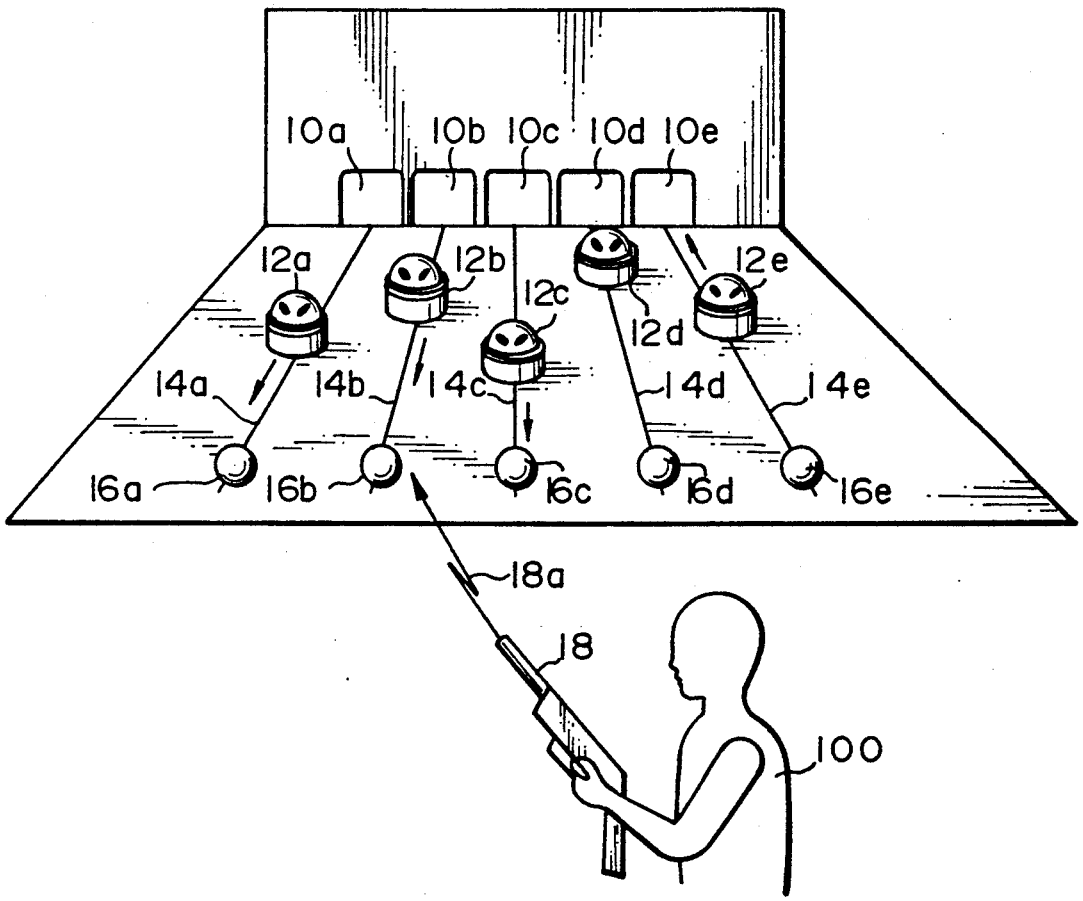
FIG. 2 is a schematic view showing the configuration of the shooting game machine of FIG. 1.

FIG. 2 shows an example of a shooting game machine according to this invention. The shooting game machine includes a plurality of lanes 14*a*, 14*b* . . . 14*e* which are in parallel to one another and extend toward the player, and monsters 12*a*, 12*b* . . . 12*e* as movable members which are movable along the lanes 14*a*, 14*b* 14*e*.

Caves 10*a*, 10*b* . . . 10*e* are disposed at the backward end of the lanes 14*a*, 14*b* . . . 14*e* and serves as the starting points and goals On the forward end of the lanes 14*a*, 14*b* . . . 14*e* near the player are movably disposed treasures 16*a*, 16*b* . . . 16*e*, which define the positions of the turning points of the monsters 12*a*, 12*b* . . . 13*e*. Thus each treasure 16*a*, 16*b* . . . 16*e* serves as a turning point defining member.

In the shooting game machine, just on the start of the game, doors of the caves 10*a*, 10*b* . . . 10*e* open and a plurality of monsters 12*a*, 12*b* . . . 12*e* as targets start marching toward the treasures 16*a*, 16*b* . . . 16*e* along the corresponding lanes 14*a*, 14*b* . . . 14*e*. The individual monsters 12*a*, 12*b* . . . 12*e* continue progressing until they reach the treasures 16*a*, 16*b* . . . 16*e* at the forward end of the associated lanes 14*a*, 14*b* . . . 14*e*, whereupon the monsters 12*a*, 12*b* . . . 12*e* shift their courses and return to the caves 10*a*, 10*b* . . . 10*e* , carrying the treasures 16*a*, 16*b* . . . 16*e*. When at least one of the treasures 16*a*, 16*b* . . . 16*e* is brought into the cave 10, then the game is over.

In the above-mentioned shooting game machine, a gun 18 is used as hitting means adapted to be operated by the player to shoot the movable members 12*a*, 12*b* . . . 12*e*. From the gun 18, beam light 18*a* instead of a bullet is thrown.

When a monster is hit by the beam light 18*a* during progressing to get the treasure 16*a*, 16*b* . . . 16*e*, the monster 12*a*, 12*b* . . . 12*e* makes an effect sound and returns to the cave 10*a*, 10*b* . . . 10*e* , and after a while comes out from the cave 10 to try again to take the treasure 16.

The present invention features that when the monster 12 is hit by the beam light during carrying the treasure 16 back to the cave 10, the monster 12 leaves the treasure 16 there and returns to the cave 10. When the monster 12 reappears from the cave 10, the distance between the cave 10 and the treasure 16 is shorter than when the game was started, thereby making the game more difficult.

Figure 9:
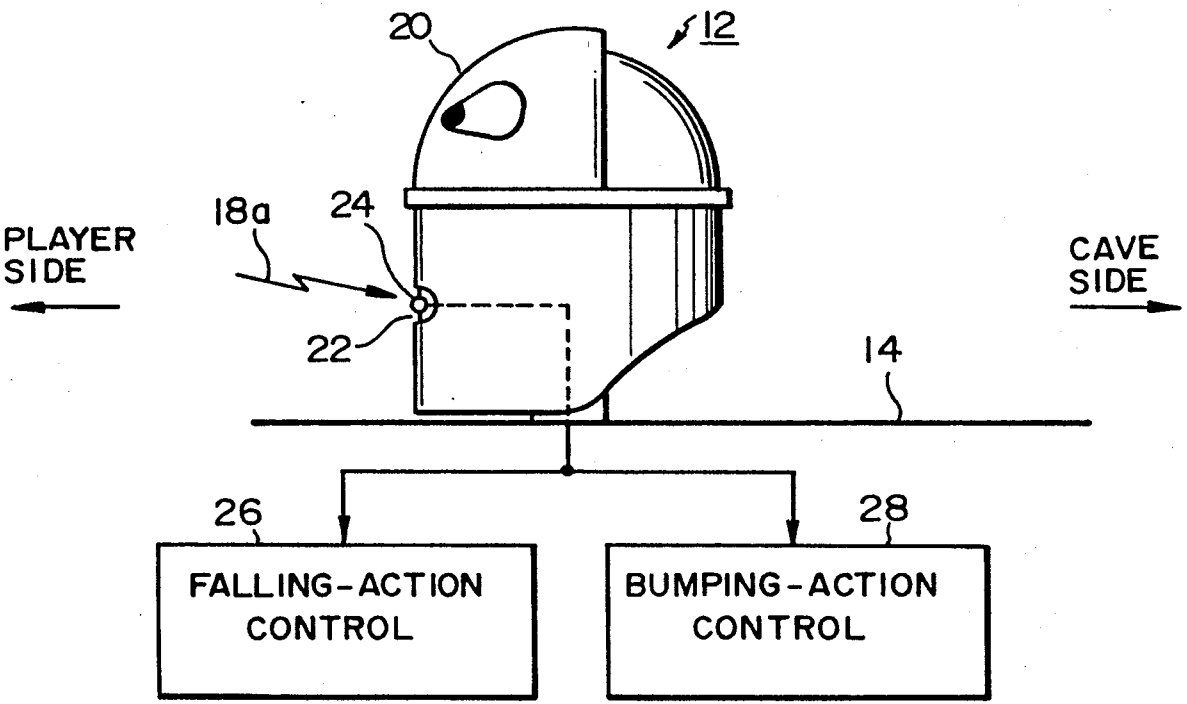
FIG. 9 illustrates a monster used as a movable member.

FIG. 9 shows an example of the monster 12 to be used for the above embodiment The monster 12 comprises a character portion 20 on which a monster's face, for example, is drawn, and a target portion 22 at which the player 100 may take aim. In the target portion 22, a light receiving element 24 is disposed and serves as a hit detector When the beam light 18*a* strikes on the target portion 22 of the monster 12, this hitting is detected by the light receiving element 24 to causes the monster to take the following hit action.

This hit action is a combination of a falling action in which the target monster 12 falls down by the reaction of the 'bullet', and a bumping action in which the target monster 12 is moved away from the player 100.

It is thereby possible to perform the hit action resembling the real hit action neatly so that the player 100 can visually enjoy more pleasantly the situation in which the monster 12 is shot by the beam light 18*a* fired from the player's gun, giving a touch of increased excitement.

To control the hit action of the monster 12 the machine has a falling-action control unit 26 and a bumping-action control unit 28.

Figure 10:
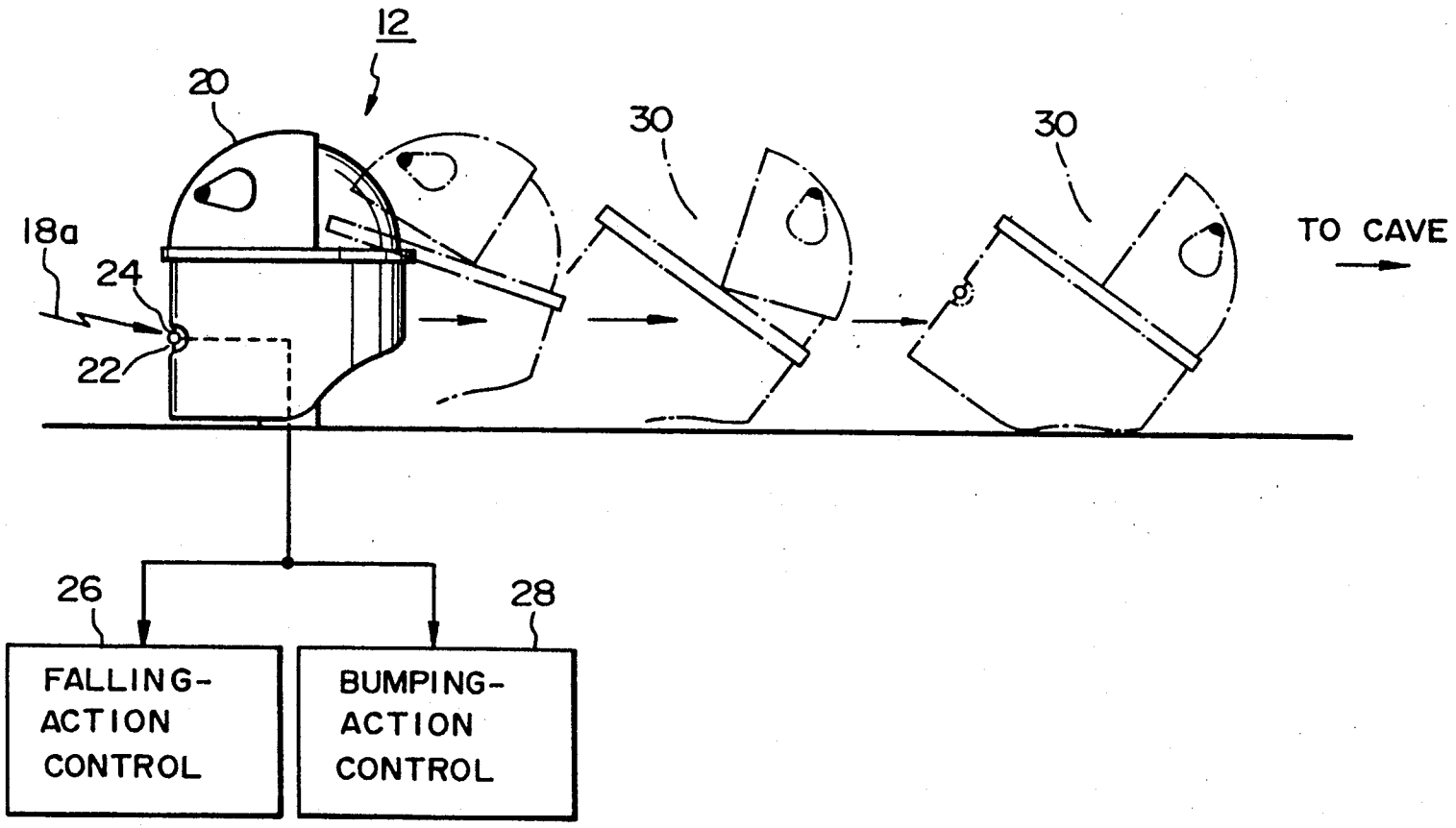
FIG. 10 is an enlarged side view of a monster in a simplified shape, showing the monster's hit action.

Upon receipt of the beam light 18*a* by the light receiving element 24, the falling-action control unit 26 causes the monster 12 to be inclined away from the player 100 by a predetermined angle as shown in FIG. 10.

Concurrently with the falling action, the bumping-action control unit 28 causes the monster 12 to return to the cave 10 at a predetermined speed, and to reappear from the cave 10 repeatedly.

As mentioned above, upon striking of the beam light 18*a* on the target portion 22, the monster 12 makes a combined action, i.e. falling action and a bumping action. The monster 12 plays visually a succession of individual hit motion; that is, the monster 12 when hit is knocked off backwardly.

In addition, the monster 12 has a large mouth 30 in the character portion 20. The mouth 30 is normally closed and is openable widely when the monster 12 is hit and falls down backwardly. With the shooting game machine of this invention, the hit action of the monster 12 can be performed with a comical touch. Also, if opening the mouth widely is accompanied by a desired effect sound, it is possible to simulate the real situation, with higher fidelity, that the monster 12 is rushing away to the cave 10 for dear life.

The operation of the shooting game machine will be described below with reference to FIG. 1. In FIG. 1, letters S and G stand for the starting point and goal (cave 10) for the monster, respectively; and P, the turning point where the treasure 16 is disposed.

Just on the start of the game, doors of the caves 10*a*, 10*b* . . . 10*e* open and monsters 12*a*, 12*b* . . . 12*e* start marching toward the treasures 16*a*, 16*b* . . . 16*e* corresponding to them.

Under this condition, the distance between the starting point S and the turning point $P_0$ is long enough, and the player can take aim at the marching monsters 12*a*, 12*b* . . . 12*e* and hit them with some ease to drive them away before they reach the treasures 16. A monster 12 hit by the beam light 18*a* returns to the cave 10 and after a while comes out therefrom again to take the treasure 16. Since the way to the treasure 16 is still long enough, the player can strike on the monster 12 to drive it away with ease.

Figure 1A:
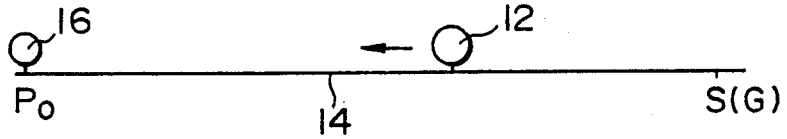
FIG. 1(A) to 1(H) are schematic views showing the operational principles of a shooting game machine according to this invention.
Figure 1B:
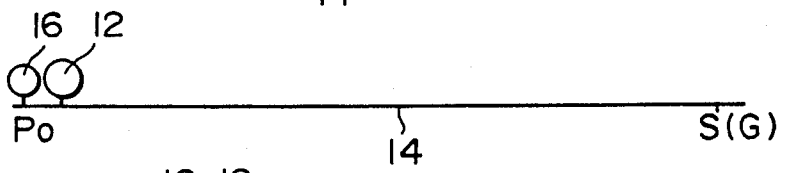
Figure 1C:
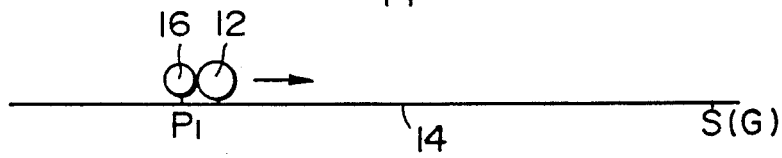
Figure 1D:
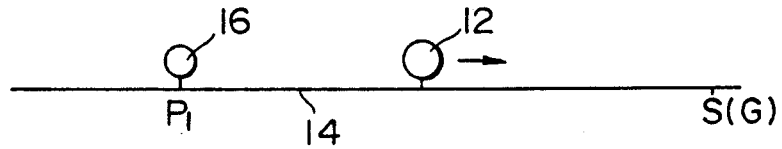
Figure 1E:
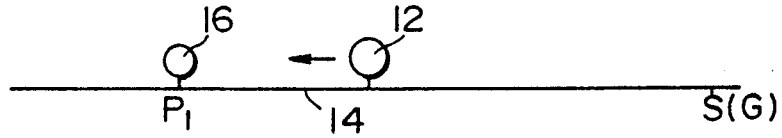

Before long any of the monsters 12*a*, 12*b* . . . 12*e* may reach the treasure 16 as shown in FIG. 1(B). As soon as it gets to the treasure 16, the monster 12 shifts its course so as to bring the treasure 16 back to the cave 10 (goal G) as shown in FIG. 1(C).

Figure 1F:
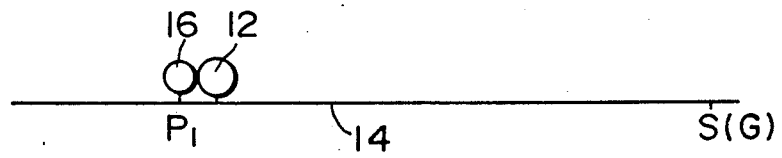
Figure 1G:
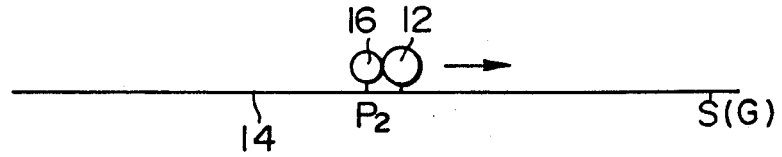
Figure 1H:
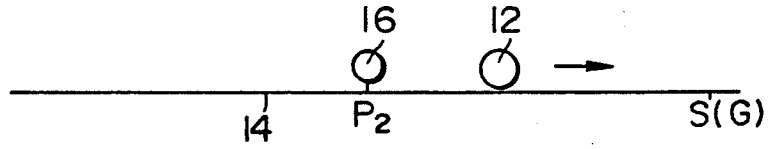

If it is hit by the beam light 18*a* during progressing to the goal, the monster 12 leaves the treasure 16 there and returns to the cave 10. After a while the monster 22 comes out from the cave 10 to try again to take the treasure 16. However, since the distance between the starting point S and the turning point P is shortened on the lane 14, where the monster 12 leaves the treasure 16, compared with those of the other lanes, the monster 12 can arrive at the treasure 16 and carry it back to the cave 10 if the player is paying attention to other monsters 12 on other lanes 14, as illustrated in FIGS. 1(F) and 1(G).

Under this condition, the player 100 should make an effort to hit monsters 12 on the other lanes to drive them away while paying special attention to the monster 12 moving along the lane 14 whose distance is shortened between the treasure 16 and the cave 10. If the player 100 is less attentive, the monster 12 will be able to bring the treasure 12 into the cave 10.

As the game goes on, the treasures 16*a*, 16*b* . . . 16*e* disposed on the lanes 14*a*, 14*b* . . . 14*e* are pulled toward the caves 10*a*, 10*b* . . . 10*e* , thereby rendering the game more difficult and more exciting. Therefore the player 100 becomes tense and concentrated on the progress of the game in order to hit the monsters 12*a*, 12*b* . . . 12*e* moving on the lanes 14*a*, 14*b* . . . 14*e*. The game itself becomes more exciting as it progresses, and reaches a climax at the end thereof.

Even if any of the treasures 16 is brought into the cave 10 before lapse of the predetermined period of time and the game is over, the player 100 can enjoy the climax of the game just before the game is over, and will feel satisfied as he can taste the aftermath of tension and excitement felt during the game.

Figure 3:
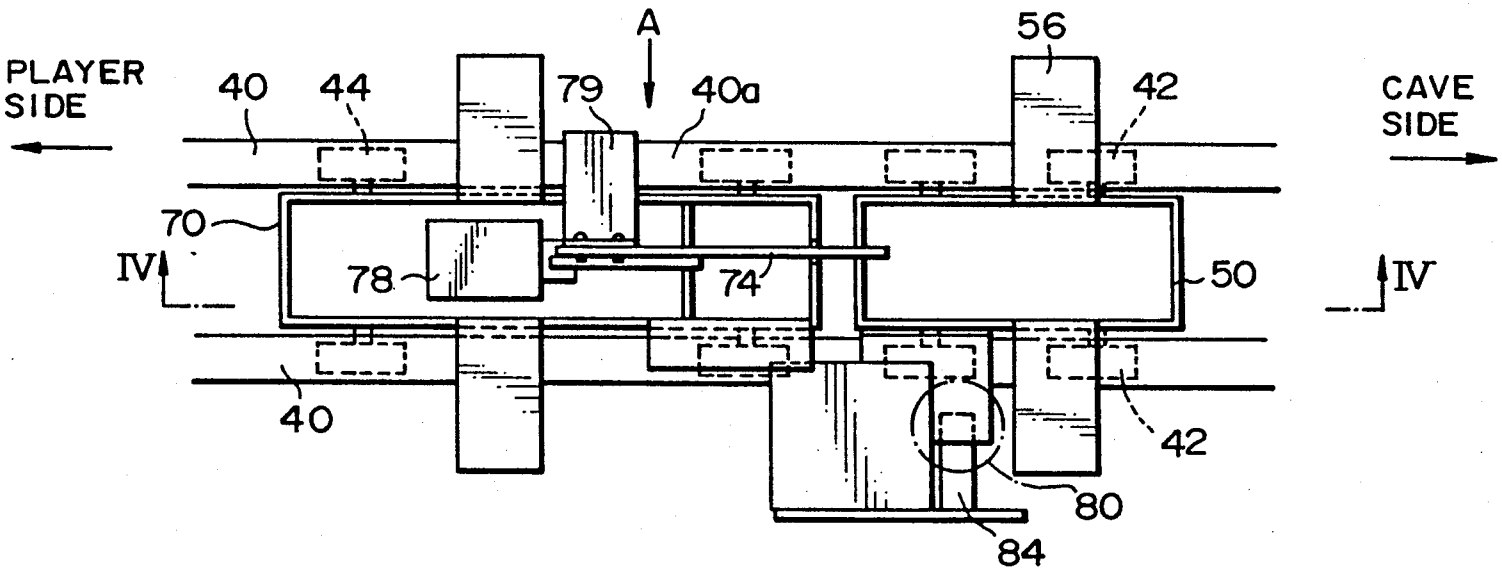
FIG. 3 is an elevational view showing the arrangement of driving systems such as targets illustrated in FIG. 2.
Figure 4:
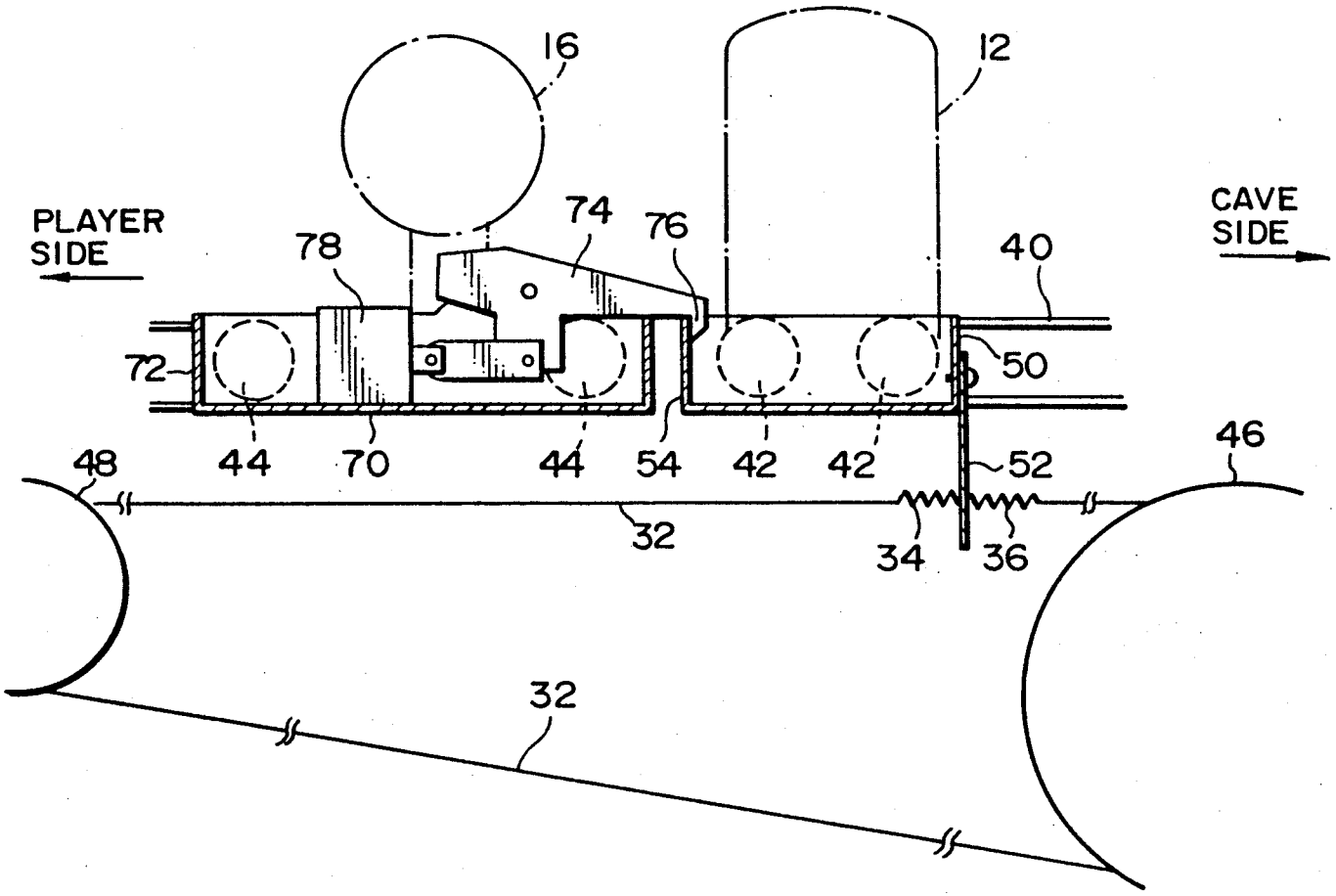
FIG. 4 is an elevational view taken along the line IV—IV of the driving system shown in FIG. 3.

FIG. 3 is a plan view showing a system for driving the monsters 12 and the treasures 16, and FIG. 4 is a sectional view of the driving system, taken along the line IV—IV of FIG. 3.

Figure 5:
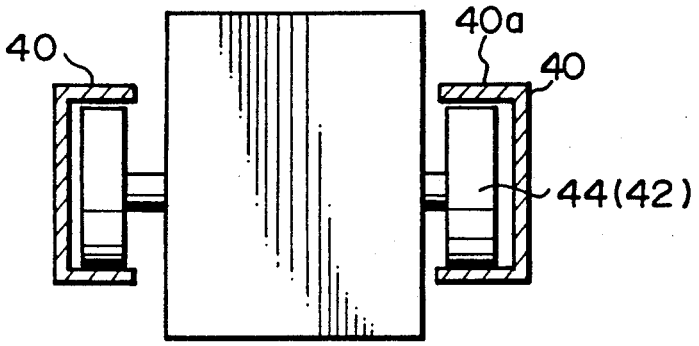
FIG. 5 is an elevational view showing the movement of a movable member on rails illustrated in FIGS. 3 and 4.

Each of the lanes 14 is composed of a pair of channel-shaped rails 40 as shown in FIG. 5. The movable members such as the monsters 12 and the treasures 16 are adapted to move along the rails 40 by means of wheels 44, 42.

In FIGS. 3 and 4, reference numeral 50 designates a first movable member, on which a monster is fixed.

A body frame 54 for the first movable member 50 includes a wire mounting plate 52 fixed at the lower end thereof and projecting downwardly. The wheels 42 are pivotally supported at both sides of the frame 54, and are housed in the rails 40.

A drive pulley 46 and a driven pulley 48 are disposed at lower sides of the rails 40, and are faced each other. A wire 32 laid around the drive and driven pulleys 46, 48 are led to the wire mounting plate 52 and fixed thereon via springs 34, 36.

When the drive pulley 46 is rotated counterclockwise as shown in FIG. 4, the first movable member 50 causes the monster 12 to move toward the player. When the pulley 46 is rotated clockwise, the first movable member 50 causes the monster 12 to move toward the cave.

Figure 6:
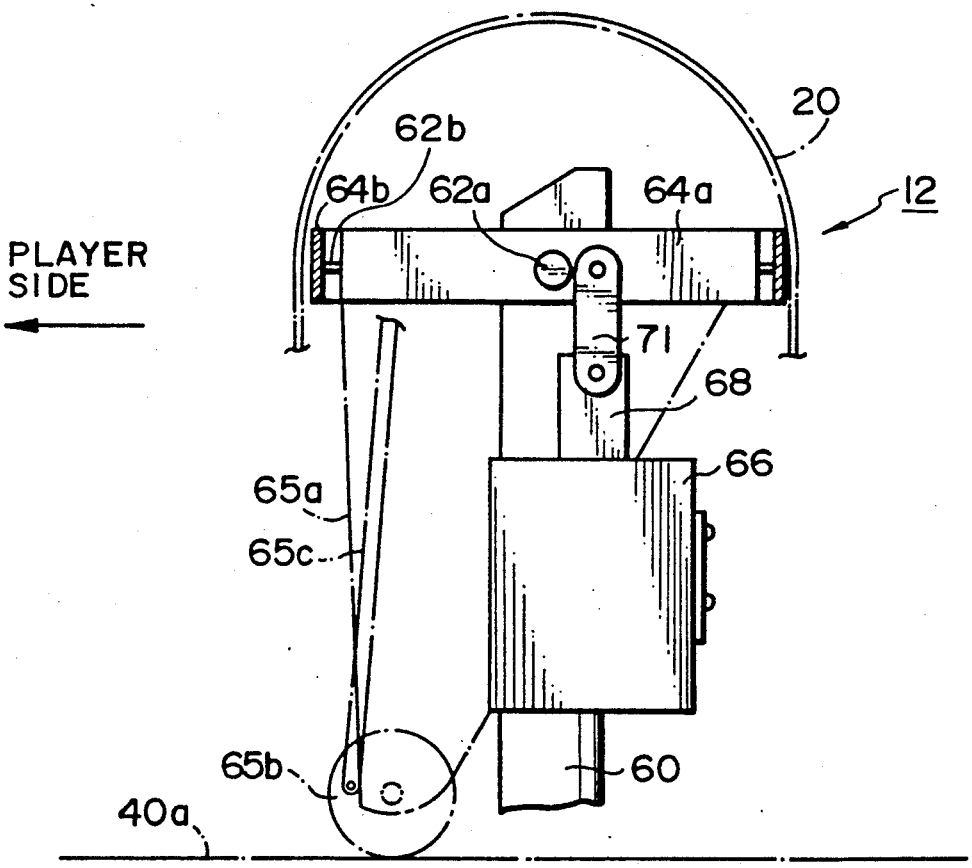
FIG. 6 shows a member for mounting a first movable member.

FIG. 6 is an enlarged side view of a monster 12 mounted on the first movable member 50.

The monster 12 is fixed at one end of a support 60 (disposed on the body frame 54) via an inner frame 64*a* and an outer frame 64*b* so as to be rocked right and left, or back and forth during its progressing. To be more specific, the inner frame 64*a* is mounted at the end of the support 60 via an axis 62*a* so that it is rockable back and forth during the forward movement of the character portion. In addition, the outer frame 64*b* is attached to the end of the inner frame 64*a* via the axis 62*b* so that the outer frame 64*b* is rockable right and left during the forward movement of the character portion. The character portion 20 of the monster 12 is integrally attached to the outer frame 64*b*, so that the character portion 20 is rocked back and forth together with the inner frame 64*a*, and is rocked right and left together with the outer frame 64*b*.

In this embodiment, the monster 12 is adapted to move along the lane 14 with its character portion 20 rocking right and left. A roller mounting frame 65*a* is integrally mounted in the inner frame 64*a*. And a roller 65*b* is pivotally mounted at the tip of the roller mounting frame 65*a*. An eccentric rod 65*c* from the roller 65*b* is attached to right side of the outer frame 64*b* (not shown) viewed in the forward direction. When the monster 12 is caused to move, the roller 65*b* in contact with an upper surface 40*a* of the rails 40 begin rotating, and causes the right side of the outer frame 64*b*, which is connected to the roller 65*b* via the eccentric rod 65*c*, to move vertically. Thus the outer frame 64*b* rocks, around the axis 62*b*, right and left in the forward direction. Thus the monster 12 moves along the lane 14 while rocking its character portion 20 right and left.

A solenoid 66 is fixed on the support 60, and a rod 68 for operating the solenoid 66 is fixed to the inner frame 64*a* via a link 71.

Therefore the solenoid 66 is operated to cause the character portion 20 to fall down backwardly together with the inner frame 64*a*. Each time the monster 12 is hit, the solenoid 66 is operated to let the character portion 20 fall down in the reaction of the hitting.

Concurrently the roller 65*b*moves upwards together with the inner frame 64*a* and is out of contact from the rails 40. When the movable member 50 goes back to the cave 10 under this condition, the character portion 20 is not rocked right and left.

In FIGS. 3 and 4, reference numeral 70 stands for a second movable member, on which the treasure 60 is disposed.

The second movable member 70 is adapted to move along the rails 40 by means of the wheels 44 disposed on both sides of the body frame 72. A hook 74 is rotatably disposed in the body frame 72. Operation of a solenoid 78 causes the hook 74 to be rotated clockwise as shown in FIG. 4. The hook 74 makes an engaging portion 76 at its end engage with the end of the body frame 54 of the first movable member 50.

Figure 7:
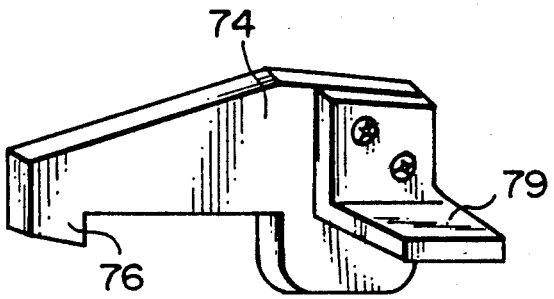
FIG. 7 shows a hook attached to a second movable member.

FIG. 7 is an enlarged view of the hook 74 viewed in the direction A shown in FIG. 3. A brake plate 79 is attached at the rear end of the hook 74, and comes into frictional contact with the upper surface 40*a* of the rails 40 The brake plate 79 remains separated from the upper surface of the rails 40 while the engagement portion 76 of the hook 74 is in contact with the first movable member 50 On the other hand the brake plate 79 comes into pressure contact with the upper surface 40*a* of the rail 40 when the hook 74 is disengaged from the first movable member 50.

The hook 74 is normally apart from the first movable member 50. Then the brake plate 79 is pressed toward the rails 40 by the hook 74, and is adapted to brake the second movable member 70.

When the first movable member 50 comes near the second movable member 70, a sensor 80 (to be described later) detects this and causes the tip of the hook 74 to be engaged with the first movable member 50. Then the second movable member 70 is released from the braked condition, and moves along the rails 40 together with the first movable member 50.

The first and the second movable members 50 and 70 include the sensor 80 for detecting their mutual approach.

Figure 8:
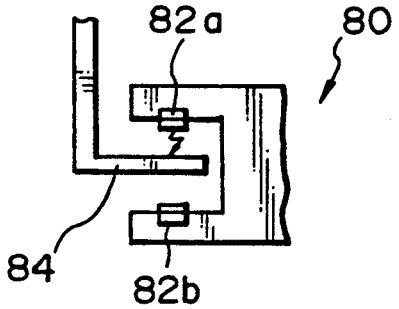
FIG. 8 shows a sensor for detecting approach of the first and second movable members.

As shown in FIG. 8, the sensor 80 comprises a light emitting element 82*a* and a light receiving element 82*b* which are disposed on a side of the first movable member 50 and are faced each other vertically, and a light shielding plate 84*a* disposed on a side of the second movable member 70. When the first movable member 50 approaches the second movable member 70, the light shielding plate 84 shields the light path of the elements 82*a* and 82*b*, detecting the approaching first movable member 50.

When the monster 12 (first movable member 50) comes out from the cave 10 and reaches the treasure 16, the sensor 80 detects this and causes the monster 12 to stop moving. Concurrently the solenoid 78 of the second movable member 70 is operated to have the hook 74 engaged with the first movable member 50 as illustrated in FIG. 4. Then the second movable member 70 is freed from the braked condition.

Immediately after the above process, the drive pulley 46 is reversely rotated, and the first movable member 50 having the monster 12 thereon begins to retreat toward the cave 10 together with the second movable member 70 bringing the treasure 16.

If the beam light 18*a* from the player 100 strikes on the monster 12 during the retreat, the second movable member 70 operates the solenoid 78 according to the signal from the light receiving element 24 serving as the hit detector, releases the first movable member 50 from the hook 74, and stops there following the braking action of the brake plate 79.

At the same time, the first movable member 50 operates the solenoid 66, shown in FIG. 6, to cause the character portion 20 to fall down backwardly in the reaction of the hitting action. Besides the drive pulley 46 is accelerated to make the monster 20 return to the cave 10 as if it is knocked off by the reaction of the hitting action.

When the first movable member 50 comes near the cave 10, a sensor, not shown, detects the position of the movable member 50 and causes the member 50 to be stopped in the cave 10.

While this invention has been particularly described with reference to the preferred embodiment thereof, it will be understood by those skilled in the art that various changes in form and detail can be made therein without departing spirit and scope of the invention as illustrated.

In the foregoing embodiment, the monsters 12*a* 12*b* . . . 12*e* are adapted to be movable along the lanes 14*a*, 14*b* . . . 14*e* which are disposed horizontally. However this invention is also applicable to a shooting game machine in which monsters 12*a*, 12*b* . . . 12*e* are movable along vertically disposed lanes 14*a*, 14*b* . . . 14*e*.

In the described embodiment, when it is hit by the beam light while carrying the treasure 16 to the cave 10, the monster 12 leaves the treasure 16 there and returns to the cave 10 alone. It is also feasible that several positions are predetermined for the monster 12 to leave the treasure when it is hit on its way back to the cave. When it is hit on its first return to the cave, the monster 12 leaves the treasure 16 at a first position On its second, third . . . return, the monster 12 leaves the treasure 16 at a second, a third . . . position which is nearer the cave 10.

Although the gun 18 for emitting the beam light 18*a* is described as an example of a gun, any other guns such as ultrared beam guns or BB (air) guns may be usable as the hitting means.

The gun 18 is described as the hitting means in the foregoing embodiment, but any type of hitting means is also applicable. For example, a hammer-shaped member may be used to knock down the monsters 12*a*, 12*b* . . . 12*e* instead of the hitting action by the gun 18. Any kind of members can be used as hitting means.

The monsters 12*a*, 12*b* . . . 12*e* are described as the movable members in the above embodiment, but they may be replaced with any members having a variety of characters. In addition, the treasures 16 as the turning points may be of any other members according to the scenarios of the shooting game.

In the shooting game machine according to this invention, the player tries to hit the respective movable members marching from the starting point to the goal via the turning point so as to prevent them from reaching the goal. Each time the movable members reach the turning point, the turning point is moved toward the starting point so as to shorten the distance between the starting point and the turning point and to make the game more difficult. Therefore the shooting game machine can keep the player tensioned, excited from the beginning till the end of the game.

What is claimed is:

1. A shooting game machine comprising:

(a) a plurality of lanes having a starting point and a turning point at ends thereof respectively;

(b) a plurality of movable members which are able to start from said starting point and are able to turn at the respective turning points to march toward a goal;

(c) hitting means adapted to be operated by a player for hitting said movable members in an effort to prevent the movable members from reaching the goal;

(d) movable member control means for returning said hit movable members to the starting point and restarting them therefrom; and (e) means for moving the turning point toward the starting point so as to shorten the distance between the starting point and the goal and to make the game more difficult each time said movable members reach the turning point.

2. A shooting game machine according to claim 1, wherein said turning point moving means is such that the respective turning point of said lanes are moved toward the starting point together with said movable members during a period of time before said movable members are hit by the player and after they reach the turning points so that the distance between the starting point and the goal is gradually shortened so as to make game more difficult and exciting.

3. A shooting game machine according to claim 2, wherein said hitting means is a gun adapted to be operated by the player for shooting said movable members.

4. A shooting game machine according to claim 1, wherein said turning point moving means includes a turning point defining member defining the turning point of the respective lane, said turning point defining member being movable toward the starting point together with said movable members during a period of time before said movable members are hit and after they reach the turning point so that the distance between the starting point and the goal is shortened so as to make the game more difficult and exciting.

5. A shooting game machine according to claim 4, wherein when reaching said turning point moving means, said movable members move toward the starting point while pulling said turning point moving means by using a joint member, and when said movable members are hit and released from said turning point moving means, said movable members return to the starting point.

6. A shooting game machine according to claim 5, wherein said hitting means is a gun adapted to be operated by the player for shooting said movable members.

7. A shooting game machine according to claim 6, wherein each of said movable members comprises a character portion bearing a character, a target portion at which the player may take aim, and a hit detector disposed in said target portion so as to detect the hitting of the individual movable member, each said movable member being adapted to fall down by the reaction of the hitting and to move toward the starting point so that the player can visually produce the situation in which the individual movable member is shot.

8. A shooting game machine according to claim 7, wherein said lanes extend toward the player, said movable members being mounted one on each of said lanes so as to be movable along said lanes independently of one another.

9. A shooting game machine according to claim 8, wherein said movable member control means includes a character driving member to cause said character portion to fall down and move toward the starting point so that the player can visually produce the situation in which individual movable member is shot.

10. A shooting game machine according to claim 9, wherein said character portion of each said movable member has a mouth which is normally closed and openable widely when the individual movable member is hit and falls down backwardly so that the player visually produce the situation in which the individual movable member is shot.

11. A shooting game machine according to claim 7, wherein said movable member control means includes a character driving member to cause said character portion to fall down and move toward the starting point so that the player can visually produce the situation in which individual movable member is shot.

12. A shooting game machine according to claim 4, wherein said lanes extend toward the player, said movable members being mounted one on each of said lanes so as to be movable along said lanes independently of one another.

13. A shooting game machine according to claim 1, wherein said hitting means is a gun adapted to be operated by the player for shooting said movable members.

14. A shooting game machine according to claim 13, wherein each of said movable members comprises a character portion being a character, a target portion at which the player may take aim, and a hit detector disposed in said target portion so as to detect the hitting of the individual movable member, each said movable member being adapted to fall down by the reaction of the hitting and to move toward the starting point so that the player can visually produce the situation in which the individual movable member is shot.

15. A shooting fame machine according to claim 14, wherein said lanes extend toward the player, said movable members being mounted one on each of said lanes so as to be movable along said lanes independently of one another.

16. A shooting game machine according to claim 14, wherein said movable member control means includes a character driving member to cause said character portion to fall down and move toward the starting point so that the player can visually produce the situation in which individual movable member is shot.

17. A shooting game machine according to claim 16, wherein said character portion of each said movable member has a mouth which is normally closed and openable widely when the individual movable member is hit and falls down backwardly so that the player visually produce the situation in which the individual movable member is hot.

18. A shooting game machine according to claim 14, wherein said character portion of each said movable member has a mouth which is normally closed and openable widely when the individual movable member is hit and falls down backwardly so that the player visually produce the situation in which the individual movable member is shot.

19. A shooting game machine according to claim 1, wherein said lanes extend toward the player, said movable member being mounted one on each of said lanes so as to be movable along said lanes independently of one another.

* * * * *